US006929448B1

(12) United States Patent
Lyons et al.

(10) Patent No.: US 6,929,448 B1
(45) Date of Patent: Aug. 16, 2005

(54) BLOWER ASSEMBLY INCLUDING EXHAUST RESTRICTION DEVICE

(75) Inventors: Leslie A. Lyons, Cassville, MO (US); David A. Fisher, Cassville, MO (US)

(73) Assignee: Fasco Industries, Inc., Cassville, MO (US)

( * ) Notice: Subject to any disclaimer, the term of this patent is extended or adjusted under 35 U.S.C. 154(b) by 17 days.

(21) Appl. No.: 10/438,423

(22) Filed: May 15, 2003

(51) Int. Cl.[7] ..... F04D 29/66

(52) U.S. Cl. ..... 415/204; 415/206; 415/211.2; 415/212.1

(58) Field of Search ..... 415/203, 204, 415/206, 207, 208.1, 211.2, 212.1, 225; 126/299 F, 126/301, 307 R, 116 R; 110/266, 162

(56) References Cited

U.S. PATENT DOCUMENTS 5,314,300 A 5/1994 Gatley, Jr. et al. ..... 415/119
5,316,439 A 5/1994 Gatley, Jr. et al. ..... 415/119
5,971,292 A * 10/1999 Roy et al. ..... 126/110 R
6,468,034 B1 10/2002 Garrison et al. ..... 415/212.1
6,530,346 B1 3/2003 Coones et al. ..... 122/4
6,575,696 B1 6/2003 Lyons et al. ..... 415/119

* cited by examiner

*Primary Examiner*—Edward K. Look
*Assistant Examiner*—Richard A. Edgar
(74) *Attorney, Agent, or Firm*—Andrus, Sceales, Starke & Sawall, LLP

(57) ABSTRACT

A blower assembly that includes an exhaust restrictor to aid in operating the blower assembly over a range of operating conditions. The blower assembly includes a blower housing having a housing exhaust opening that receives a flow of exhaust gases created by a rotating impeller. An exhaust transition section extends between the housing exhaust opening to an expanded diameter exhaust outlet sized to receive a flue pipe. The blower housing includes an exhaust restrictor positioned in the exhaust transition section between the housing exhaust opening and the exhaust outlet. The exhaust restrictor is integrally formed with a portion of the blower housing and includes a curved back wall to aid in the transition between the housing exhaust opening and the exhaust outlet.

17 Claims, 5 Drawing Sheets

BLOWER ASSEMBLY INCLUDING EXHAUST RESTRICTION DEVICE

FIELD OF THE INVENTION

The present invention is generally related to a blower assembly used to remove combustion gases from a furnace. More specifically, the present invention is directed to an exhaust restriction device positioned in the blower housing to redirect and restrict the flow of gases through the blower outlet.

BACKGROUND OF THE INVENTION

The need to heat structures to control the interior temperature has been a requirement for modern housing for a long time. One of the current popular methods used to heat structures is with a furnace that burns either oil or natural gas. Due to the increasing costs of fossil fuels, the operating efficiency of furnaces has become a greater and greater concern.

One common method of increasing the fuel efficiency of the burner within a furnace has been to utilize a blower to induce a draft through the furnace to draw the heated air and the products of combustion through a heat exchanger and finally exhaust them through an exhaust pipe. The blower increases the draft such that the heated air and the products of combustion can travel through as tortured a path as possible to increase the amount of heat removed from exhaust gases within the heat exchanger. The increase in the flow of air thereby increases the heat transfer and generating capacity of the burner while simultaneously using less fuel per BTU of heat generated. The addition of a blower motor to a furnace generates a rating of at least 80 percent fuel efficiency in a modern furnace. Thus, it is clearly a necessity to introduce a blower to a modern furnace to maintain minimum desired efficiency standards.

When designing a blower assembly, an important design characteristic is that the blower motor and impeller, as well as the inlet opening and outlet opening, be properly sized such that the blower is able to draw the desired amount of exhaust gases from a furnace to which it is mounted. If the blower motor is underrated, the blower will be underdrawing the flue gases such that the gases leaving the furnace will have a higher than desired concentration of carbon monoxide. Likewise, if the blower motor is oversized, the blower will overdraw the flue gases from the furnace. The overdrawing of the furnace results in an increased volume of the flue gases moving to quickly past the heat exchanger of the furnace, resulting in excessive exhaust temperatures entering into the blower. Thus, the blower assembly, including the blower motor and the impeller, must be properly sized to operate within specified flow characteristics.

A secondary requirement for blower assemblies is that the blower must adequately operate the gas appliance when the voltage used to operate the blower assembly is reduced. Such a reduction in voltage can occur during low power situations, such as a brownout, in the geographic area where the blower is installed.

Presently, multiple solutions have been designed to address the issues identified above. The first solution is to provide a flow restriction at the blower inlet. A flow restriction at the blower inlet accomplishes the need for the gas appliance to operate at a reduced voltage. However, during normal operating conditions, the pressure in the blower housing is reduced, which naturally reduces the efficiency of the blower and requires a larger motor that operates at a higher speed.

A second solution is to restrict the blower outlet with a simple restrictor plate having an orifice. The orifice decreases the efficiency of the blower by reducing the effective diameter of the exhaust outlet. Since the restrictor plate typically extends perpendicular to the flow of exhaust gases, the exhaust gases strike the portions of the restrictor plate surrounding the orifice, which dramatically affects the flow rate out of the blower. Further, a hard restrictor plate at the outlet is very inefficient such that the low voltage requirements for the gas appliance cannot be met. Finally, the hard restrictor plate perpendicular to the direction of exhaust gas flow creates pressure in the exhaust adapter, which requires the joints of the exhaust adapter to be sealed by more effective and expensive means.

Therefore, it is an object of the present invention to provide a blower assembly that allows the blower to perform to properly draw combustion products through a gas appliance while also being operable in a reduced voltage environment to provide acceptable operating characteristics. Further, it is an object of the present invention to provide a blower assembly having a flow restrictor that does not reduce the pressure in the blower housing yet provides for low voltage operation.

SUMMARY OF THE INVENTION

The present invention relates to a blower assembly that includes an exhaust restrictor positioned in a blower housing that allows the blower assembly to operate in an efficient manner over changing operating voltage conditions. The exhaust restrictor extends into an exhaust transition section either attached to or integrally formed with the blower housing such that the exhaust restrictor interacts with the flow of exhaust gases out of the blower housing such that the blower assembly is operable over a range of voltages applied to the blower motor assembly.

The blower assembly of the present invention includes a blower housing that is preferably formed from a first housing member and a second housing member joined to each other. The first housing member defines a top wall and an outer sidewall for the blower housing. The second housing member defines a bottom wall for the blower housing that includes an inlet opening that receives exhaust gases from the furnace to which the blower assembly is mounted. The combination of the first housing member and the second housing member define an internal impeller cavity that receives an impeller mounted to a motor shaft extending through the top wall.

The blower housing further includes a housing exhaust opening formed in the sidewall of the blower housing. The housing exhaust opening provides an exit point for exhaust gases to flow out of the blower housing after the exhaust gases have been drawn into the impeller cavity by the rotating impeller positioned within the impeller cavity. As the impeller rotates, exhaust gases are drawn through the inlet opening and discharged through the housing exhaust opening.

An exhausts transition section is included in the blower assembly and extends from a first end coupled to the housing exhaust opening to an exhaust outlet. Preferably, the exhaust outlet is circular in shape and is configured for connection to a conventional exhaust pipe. The exhaust transition section can be either separately formed and attached to the blower housing or integrally formed with the blower housing. If the exhaust transition section is integrally formed with the blower housing, a portion of the exhaust transition section is defined by the first housing member while a mating portion of the exhaust transition section is defined by the second housing member.

The blower housing further includes an exhaust restrictor that extends into the exhaust transition section from the housing exhaust opening. The exhaust restrictor is positioned to restrict the flow of exhaust gases passing from the housing exhaust opening to the exhaust outlet.

The exhaust restrictor is preferably positioned at an inclined angle relative to the bottom wall of the blower housing. The inclined angle of the exhaust restrictor allows the exhaust restrictor to restrict the flow of exhaust gases in a gradual manner, as opposed to prior art restrictor plates that extend perpendicular to the direction of exhaust gas flow.

The exhaust restrictor includes a back wall including a generally planar lower portion and a curved upper portion. The generally planar lower portion of the back wall extends at the inclined angle relative to the bottom wall of the blower housing. In the preferred embodiment of the invention, the lower portion of the exhaust restrictor back wall is integrally formed with the bottom wall of the second housing member. However, it is contemplated that the back wall of the exhaust restrictor could be coupled to the bottom wall of the blower housing during the assembly of the blower housing.

The exhaust restrictor of the present invention has a width that is less than the width of the housing exhaust opening formed in the sidewall of the blower housing. In this manner, the exhaust restrictor provides side flow passageways for exhaust gas to flow past the exhaust restrictor. The side passageways further limit the effect the exhaust restrictor has on the flow of exhaust gases out of the blower housing.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
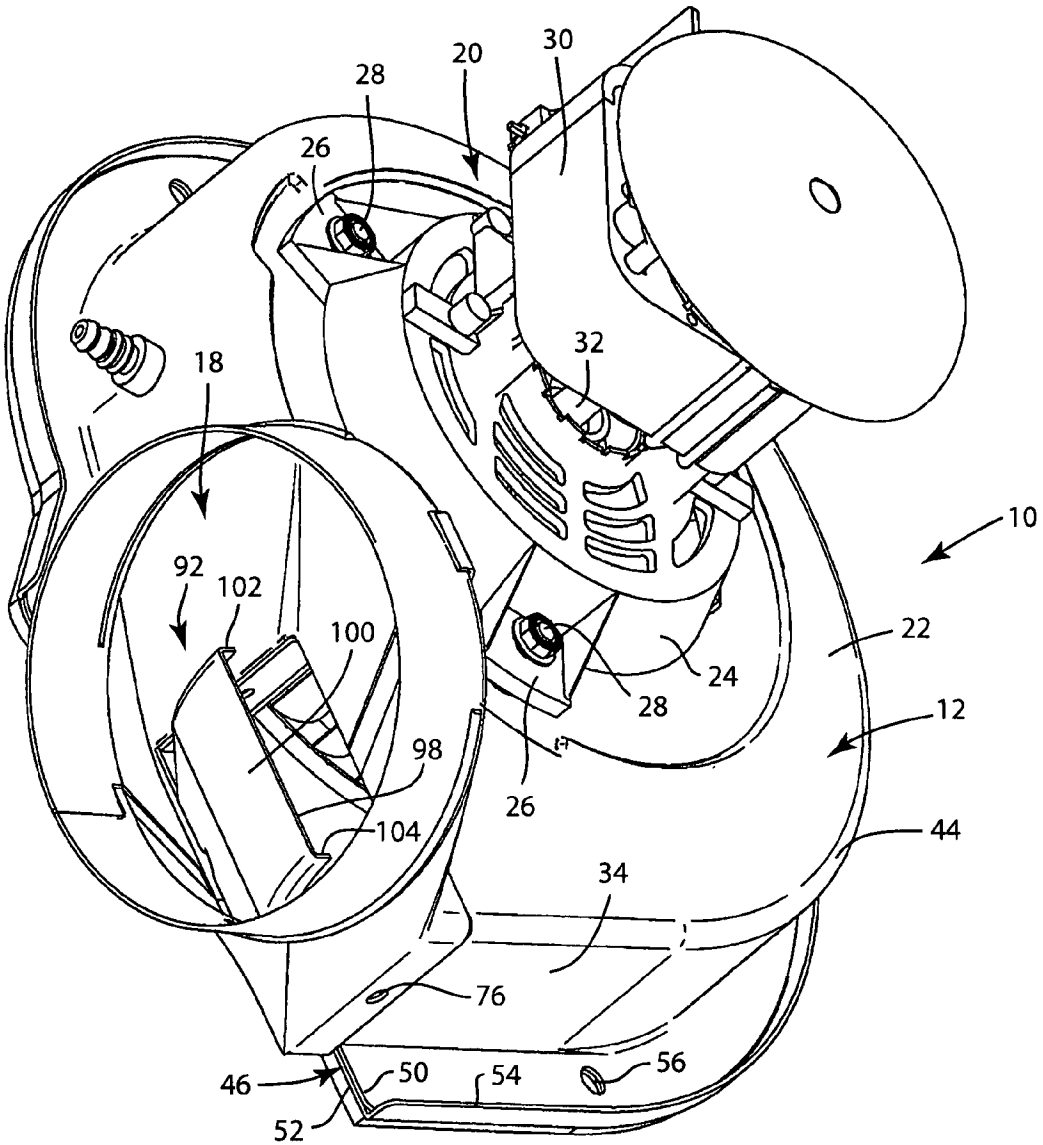
FIG. 1 is a front perspective view illustrating the blower housing and motor assembly of the present invention.
Figure 2:
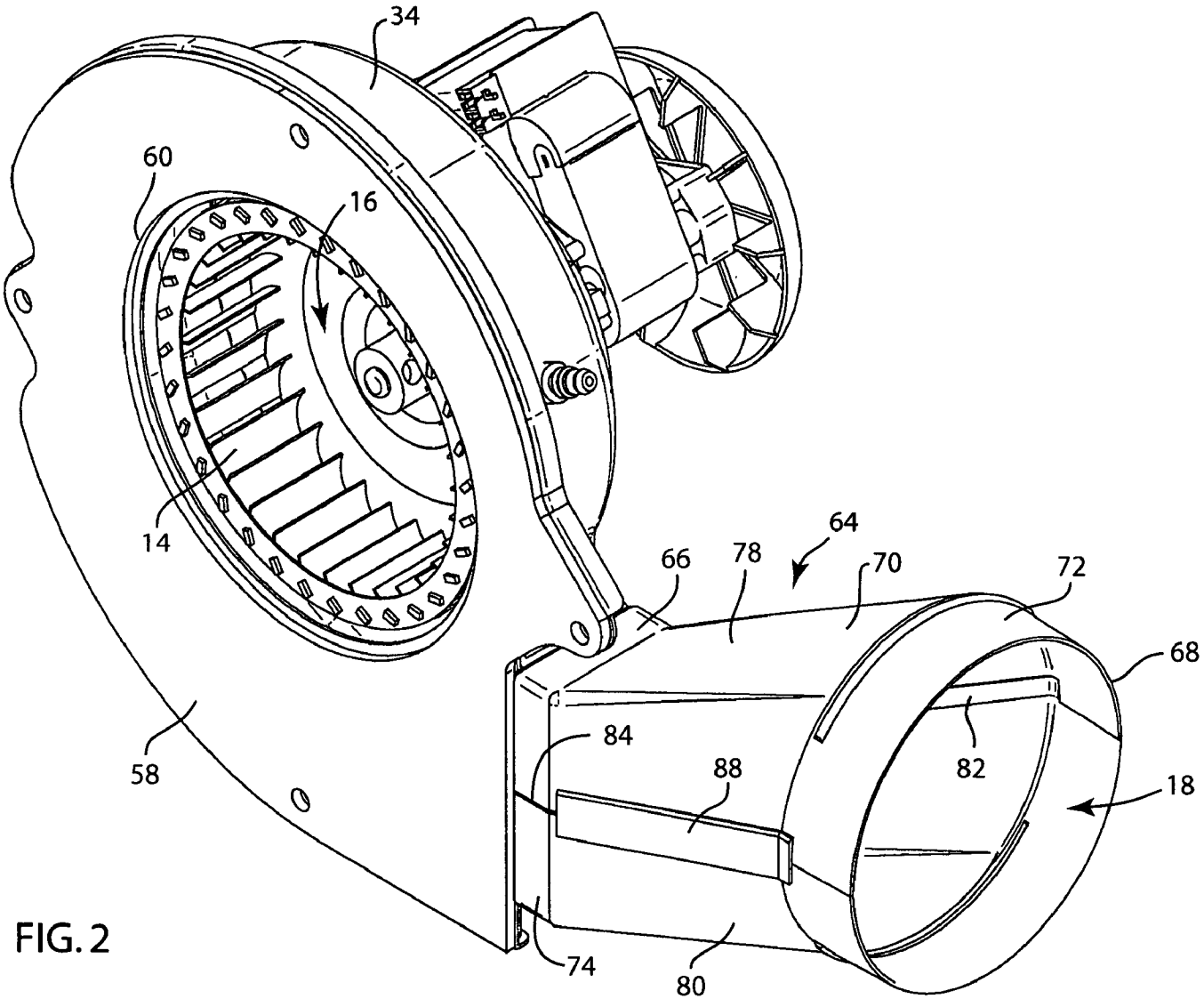
FIG. 2 is a back perspective view illustrating the inlet opening to the blower housing of the present invention.

Referring first to FIG. 1, thereshown is a blower assembly 10 constructed in accordance with the present invention. The blower assembly 10 generally includes a blower housing 12 that is configured to enclose a rotating impeller 14, as shown in FIG. 2. The rotating impeller 14 is centered around an inlet opening 16. The inlet opening 16 is positioned to receive flue gases from a furnace and direct the flue gases into contact with the rotating impeller 14, which then directs the exhaust gases out of an exhaust outlet 18. As illustrated in FIGS. 1 and 2, the exhaust outlet 18 is circular in shape such that the exhaust outlet 18 is capable of receiving the end of a round flue pipe to direct the flue gases away from the furnace.

As best illustrated in FIG. 1, a blower motor assembly 20 is mounted to the top surface 22 of the blower housing 12. Specifically, the motor assembly 20 includes a fan shroud 24 that includes a plurality of attachment feet 26 that each receive a connector 28 to secure the blower motor assembly 20 to the top surface 22 of the blower housing 12.

Figure 4:
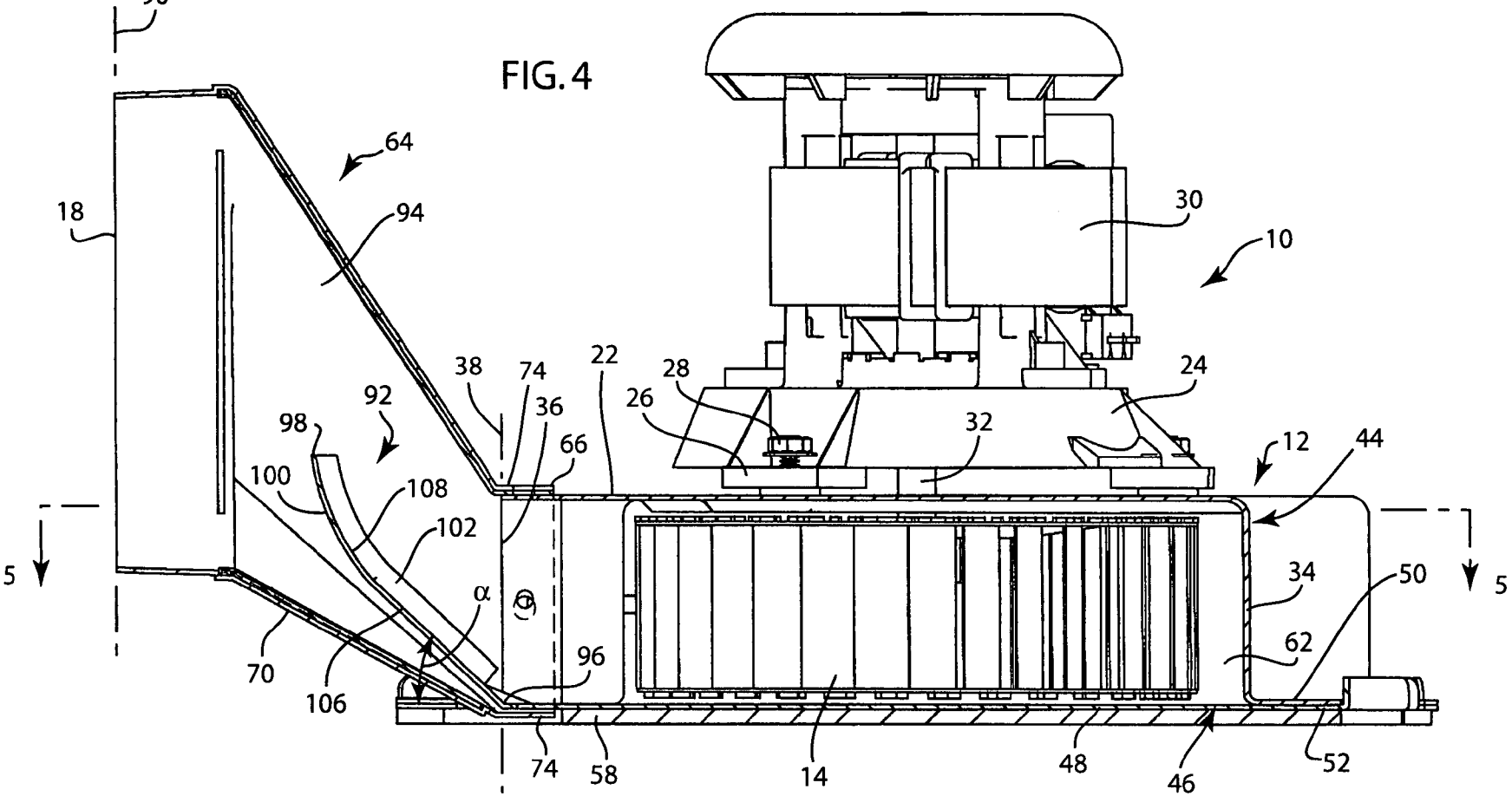
FIG. 4 is a section view taken along line 4—4 of FIG. 3.

As illustrated in FIG. 1, the blower motor assembly 20 includes a blower motor 30 having a motor shaft 32 that extends through an opening formed in the top wall 22 of the blower housing 12. As can be seen in FIG. 4, the motor shaft 32 is coupled to the impeller 14 such that rotation of the motor shaft 32 results in corresponding rotation of the impeller 14. The specific configuration of the impeller 14 is well known in the prior art and the specifics of the embodiment will not be discussed in the present application.

Referring now to FIG. 2, the impeller 14 is centered above an inlet opening 16 such that the impeller 14 draws a flow of exhaust gases through the inlet opening 16. The flow of exhaust gases drawn through the inlet opening 16 is directed radially outward against an outer sidewall 34 of the blower housing 12. The other sidewall 34 has a curved configuration such that the flow of exhaust gases is directed to a housing exhaust opening 36, as shown in FIG. 4. The housing exhaust opening 36 is rectangular in cross-section and extends along a vertical plane, as illustrated by the dashed lines 38 in FIG. 4.

Figure 5:
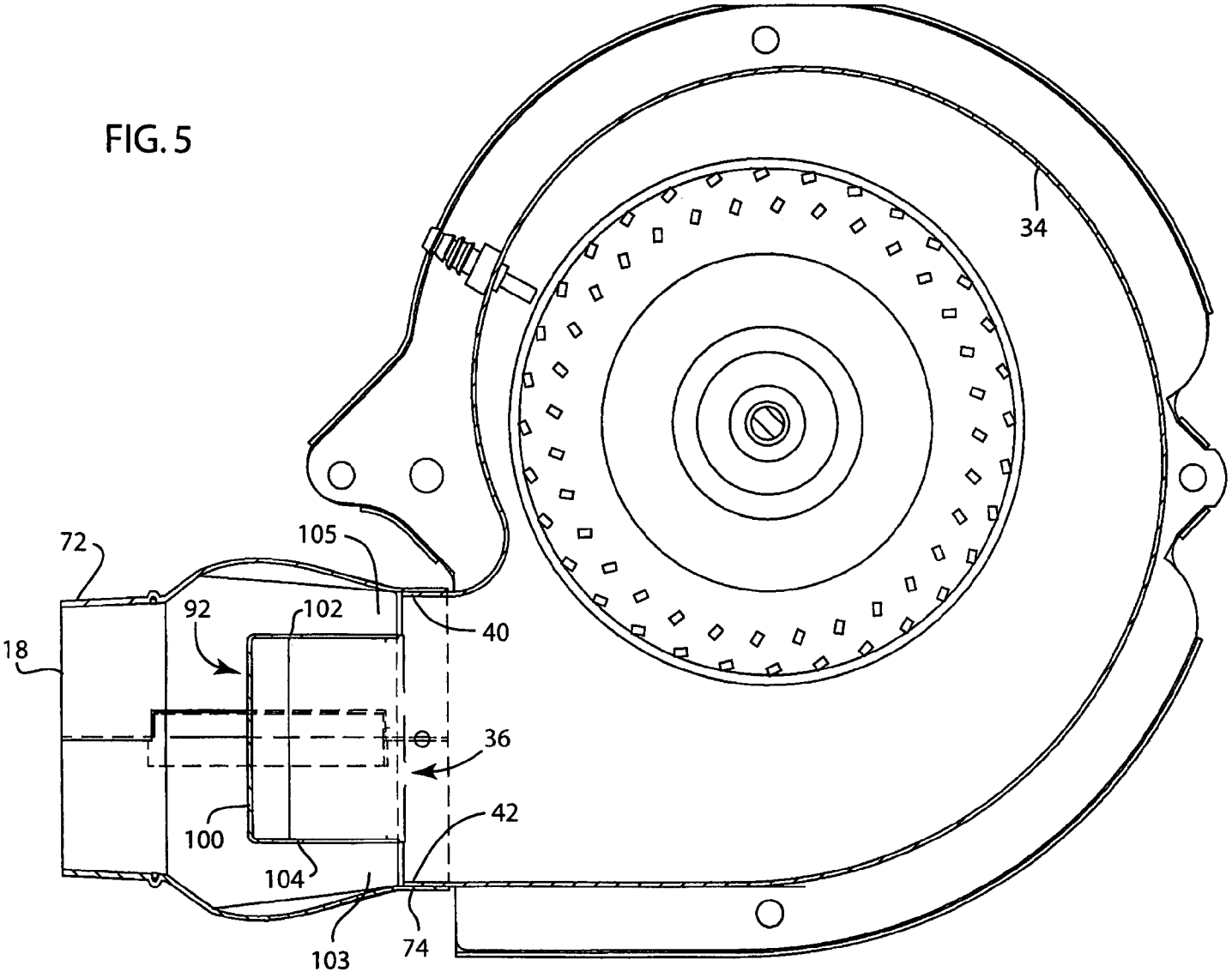
FIG. 5 is a section view taken along line 5—5 of FIG. 4.

Referring now to FIG. 5, the curved sidewall 34 of the blower housing is a continuous member that extends from a first end 40 to a second end 42. The distance between the first end 40 and the second end 42 defines the width of the housing exhaust opening 36. The height of the housing exhaust opening 36, as best shown in FIG. 4, is determined by the height of the sidewall 34. Thus, in the embodiment of the invention illustrated, the housing exhaust opening 36 has a rectangular cross-section.

Referring now to FIG. 4, in the embodiment of the invention illustrated, the blower housing 12 is formed from a first housing member 44 and a second housing member 46. The first housing member 44 defines the sidewall 34 and the top wall 22 while the second housing member 46 defines the bottom wall 48. The bottom wall 48 defines the inlet opening 16 shown in FIG. 2.

As can be seen in FIGS. 1 and 4, the first housing member includes an outer flange 50 that projects laterally from the sidewall 34 to define an outer peripheral surface. The outer flange 50 of the first housing member 44 contacts a corresponding outer flange 52 formed on the second housing member 46. As shown in FIG. 1, the outer flange 52 includes a projecting lip 54 that can be compressed downward to secure the first housing member 44 to the second housing member 46. As illustrated in FIG. 1, both of the outer flanges 50 and 52 include aligned connector openings 56 that allow the entire blower assembly 10 to be secured to a furnace in a conventional manner.

In the preferred embodiment of the invention, both the first housing member 44 and the second housing member 46 are each formed from a sheet of metallic material, such as stainless steel. Both the first housing member 44 and the second housing member are stamped from separate sheets of metallic material and secured to each other along the outer flanges 50, 52. After the blower housing 12 has been constructed from the first housing member 44 and the second housing member 46, the blower motor assembly 20 is attached to the top wall 22 through the use of the plurality of connectors 28.

Referring back to FIGS. 2 and 4, the blower assembly 10 further includes a gasket 58 that is positioned in contact with the bottom wall 48 of the blower housing. The gasket 58 includes a central opening 60 aligned with the inlet opening 16 and the impeller 14. The gasket 58 is formed separate from the blower housing and provides additional stability and a seal for the blower housing when mounting the blower housing to a furnace. Although the gasket 58 is shown in the embodiment of the invention illustrated, it is not required for the blower assembly 10 of the present invention.

Referring back again to FIG. 4, the impeller 14 is contained within an impeller cavity 62 generally defined by the sidewall 34, the bottom wall 48 and the top wall 22. As the impeller 14 rotates within the impeller cavity 62, exhaust gases are drawn through the inlet opening 16 and directed through the housing exhaust opening 36. Referring now to FIG. 2, the blower assembly 10 of the present invention includes an exhaust transition section 64 that extends from a first end 66 to the exhaust outlet 18 contained on its second end 68. The transition section 64 includes a peripheral outer wall 70 that connects the first end 66 to the second end 68 including the exhaust outlet 18. As illustrated in FIG. 2, the second end 68 includes an outer rim 72 that defines the circular shape of the exhaust outlet 18. Preferably, the exhaust outlet 18 is circular and has a diameter of four inches such that the exhaust outlet can receive a standard exhaust flue pipe. However, it should be noted that other diameters for the exhaust outlet 18 are contemplated as being with in the scope of the present invention.

As illustrated in FIG. 2, the first end 66 of the transition section 64 includes a mounting flange 74 extending from the outer wall 70. The mounting flange 74 in the preferred embodiment of the invention has a rectangular cross-sectional shape such that the mounting flange 74 can be received on the housing exhaust opening 36 of the blower housing 12, as best seen in FIG. 5. As illustrated in FIG. 5, the mounting flange 74 overlaps both the first end 40 and the second end 42 of the housing sidewall 34 as well as overlapping the top wall 22 and the bottom wall 48, as illustrated in FIG. 4. Preferably, a series of connectors pass through openings 76 formed in the mounting flange 74 to secure the exhaust transition section 64 to the blower housing 12, as best illustrated in FIG. 1.

In the preferred embodiment of the invention, the exhaust transition section 64 is formed from a first, right section 78 and a second, left section 80 joined to each other along a top seam 82 and a bottom seam 84, as best illustrated in FIG. 2. Preferably, both the first section 78 and the second section 80 are formed from stamped sections of metal. The formation of the first section 78 and the second section 80 from stamped metal greatly reduces the cost of forming the transition section 64.

Figure 3:
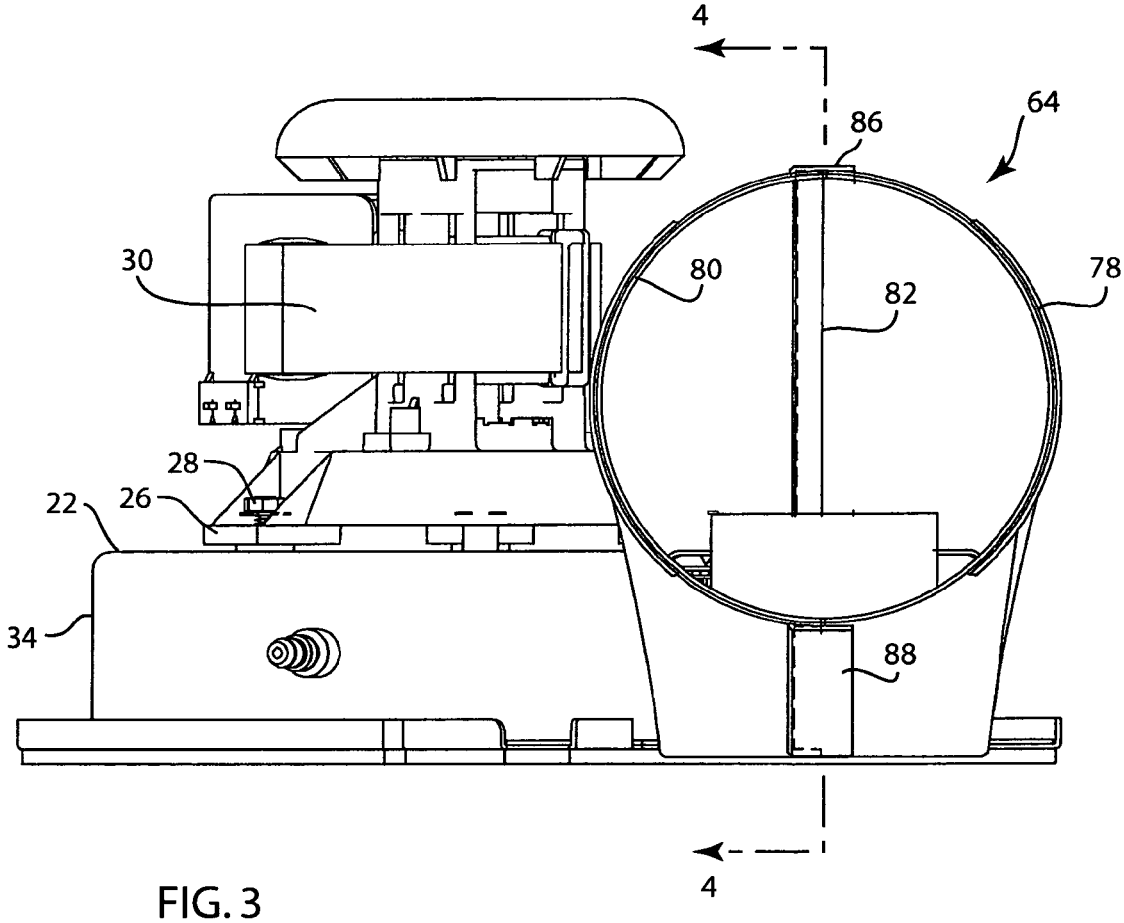
FIG. 3 is a front view of the blower housing of the present invention illustrating an exhaust gas restrictor.

As illustrated in FIG. 3, the second section 80 includes an upper flange 86 and a lower flange 88 that provides points of attachment between the two sections when joined as illustrated. In the preferred embodiment of the invention, the right and left sections 78, 80 of the exhaust transition section 64 can be joined using conventional metal working techniques.

Referring now to FIG. 4, the exhaust transition section 64 extends upward from the first end 66 to the exhaust outlet 18. As illustrated, the exhaust outlet 18 extends along a plane illustrated by reference lines 90. The plane 90 of the exhaust outlet 18 is generally parallel and spaced from the plane 38 including the housing exhaust opening 36.

Although the exhaust transition section 64 as shown in the preferred embodiment of the invention as being a separate component attached to the blower housing 12, it is contemplated by the inventors that the exhaust transition section 64 could be integrally formed with the blower housing 12. A blower housing including an integrally formed exhaust transition section is shown in the commonly owned U.S. Pat. No. 6,468,034, the disclosure of which is incorporated herein by reference.

Referring now to FIG. 4, the blower assembly 10 further includes an exhaust restrictor 92. The exhaust restrictor 92 extends into the open interior 94 defined by the outer wall 70 of the exhaust transition section 64. The exhaust restrictor 92 is positioned to restrict and interrupt the flow of exhaust gases leaving the housing exhaust opening 36 as the flow of exhaust gases move toward the exhaust outlet 18. The flow of exhaust gases is created by the rotational movement of the impeller 14 within the impeller cavity 62.

As illustrated in FIG. 4, the exhaust restrictor 92 extends from an inner end 96 to an outer end 98. As illustrated in FIG. 1, the exhaust restrictor 92 generally includes a lateral back wall 100 integrally formed with a pair of upstanding sidewalls 102 and 104. As can be understood in FIG. 5, the width of the back wall 100 between the sidewalls 102 and 104 is less than the width of the housing exhaust opening 36 such that the exhaust restrictor 92 contacts a substantial portion of the exhaust flow through the housing exhaust opening 36.

As illustrated in FIG. 5, the difference in the width of the back wall 100 and the width of the housing exhaust opening 36 defines a pair of side passageways 103 and 105. The side passageways 103, 105 allow a portion of the exhaust gas flow to flow around the exhaust restrictor 92 and out of the exhaust outlet 18. The side passageways 103, 105 thus provide alternate flow passageways for the exhaust gas flow without contacting the exhaust restrictor 92. During conditions of low voltage, the side passageways 103, 105 allow the reduced flow of exhaust gases a less restricted flow path around the exhaust restrictor 92, which aids in maintaining the efficiency of the blower assembly.

Referring again to FIG. 4, the back wall 100 includes a generally planar lower portion 106 and a curved upper portion 108. In the embodiment of the invention illustrated, the lower portion 106 extends at an angle $\alpha$ of approximately 50° relative to the bottom wall 48 in the preferred embodiment. It is contemplated that the angle $\alpha$ could be within the range of 40°–60° while operating within the scope of the present invention. The curved upper portion 108 of the back wall 100 is curved upward from the transition between the lower portion 106 and the curved portion 108 to the outer end 98. As illustrated, the outer end 98 is generally parallel to the plane 90 defined by the exhaust outlet 18.

As shown in FIG. 4, the exhaust restrictor 92 is integrally formed with the bottom wall 48 of the second housing member 46 and is bent upward from the otherwise planar bottom wall 48. During construction of the blower assembly 10 of the present invention, after the first housing member 44 and the second housing member 46 are joined to each other, the exhaust transition section 64 inserted over the exhaust restrictor 92. Once in place, connectors pass between the mounting flange 74 of the exhaust transition section 64 to hold the exhaust transition section 64 in place.

In the preferred embodiment of the invention, the exhaust restrictor 92 is integrally formed with the second housing member 46. However, it is contemplated by the inventors that the exhaust restrictor 92 could be separately formed and attached using conventional metal forming techniques to the bottom wall 48. Such metal forming techniques could be spot welding or another type of interference fit.

During normal operating conditions of the blower assembly 10, the blower motor 30 is operating at a desired speed and creating a desired exhaust flow through the housing exhaust opening 36. The exhaust restrictor 92 contained within the exhaust transition section 64 contacts the flow of exhaust gases and reduces the effective passageway for the exhaust gases between the back wall 100 and the outer wall 70 of the exhaust transition section 64 above the exhaust restrictor 92. However, since the exhaust restrictor 92 is at an angle $\alpha$, the exhaust gases are initially able to flow along the lower portion 106 and past the outer end 98 without creating excess back pressure within the impeller cavity 62. The angle $\alpha$ of the exhaust restrictor 92 is a dramatic improvement over prior art restrictor plates having an orifice and blocking surfaces that extend perpendicular to the flow of exhaust gases through the housing exhaust opening.

During low voltage conditions, the operating speed of the drive motor 30 is reduced such that a smaller flow of exhaust gases is created. Since the exhaust restrictor 92 is positioned at an angle $\alpha$ and does not extend across the entire width of the housing exhaust opening 36, the exhaust restrictor creates a gradual expansion from the housing exhaust opening 36 to the exhaust outlet 18. The gradual increase in the cross-sectional area allows the exhaust restrictor 92 to permit the desired amount of exhaust flow even when the drive motor is being operated at a reduced speed due to low voltage conditions.

Various alternatives and embodiments are contemplated as being within the scope of the following claims particularly pointing out and distinctly claiming the subject matter regarded as the invention.

What is claimed is:

1. A blower assembly for use in expelling exhaust gases from a furnace through an exhaust pipe, comprising:

a blower motor having a motor shaft;

a blower housing having an impeller cavity defined by an outer sidewall, a top wall, and a bottom wall, the bottom wall including an inlet opening for communicating the exhaust gases from the furnace into the impeller cavity;

a housing exhaust opening formed in the sidewall of the blower housing and in communication with the impeller cavity;

an impeller mounted to the motor shaft and contained within the impeller cavity, wherein rotation of the impeller creates a flow of exhaust gases into the impeller cavity through the inlet opening and out of the impeller cavity through the housing exhaust opening;

an exhaust transition section extending from the housing exhaust opening to an exhaust outlet, the exhaust outlet being configured to receive the exhaust pipe; and an exhaust restrictor extending into the exhaust transition section from the housing exhaust opening and operable to restrict the flow of exhaust gases from the housing exhaust opening to the exhaust outlet of the exhaust transition section, the exhaust restrictor including a back wall extending from an inner end to an outer end, wherein the back wall is positioned at an angle relative to a first plane extending through the exhaust opening, wherein the back wall is curved at the outer end.

2. The blower assembly of claim 1 wherein the exhaust outlet of the exhaust transition section is offset from the housing exhaust opening.

3. The blower assembly of claim 2 wherein the housing exhaust opening extends along a first plane, wherein the exhaust restrictor is positioned at an angle relative to the first plane of the housing exhaust opening.

4. The blower assembly of claim 1 wherein the housing exhaust opening is rectangular and the exhaust outlet is generally circular.

5. The blower assembly of claim 1 wherein the length of the exhaust restrictor from the housing exhaust opening is less than the distance between the housing exhaust opening and the exhaust outlet such that the outer end of the exhaust restrictor is spaced from the exhaust outlet.

6. A blower assembly for use in expelling exhaust gases from a furnace through an exhaust pipe, comprising:

a blower motor having a motor shaft;

a blower housing having an internal impeller cavity defined by a top wall, an outer sidewall, and a bottom wall including an inlet opening, the blower housing being formed from a first housing member defining the top wall and the outer sidewall and a second housing member defining the bottom wall and the inlet opening;

a housing exhaust opening formed in the sidewall of the blower housing, the housing exhaust opening being in communication with the impeller cavity;

an impeller mounted to the motor shaft and contained within the impeller cavity, wherein rotation of the impeller creates a flow of exhaust gases into the impeller cavity through the inlet opening and out of the impeller cavity through the housing exhaust opening;

an exhaust transition section extending from a first end to an exhaust outlet, the first end of the exhaust transition section being coupled to the housing exhaust opening for receiving the flow of exhaust gases; and an exhaust restrictor extending into the exhaust transition section from the exhaust opening, the exhaust restrictor being operable to restrict the flow of exhaust gases from the housing exhaust opening to the exhaust outlet, the exhaust restrictor including a back wall positioned at an inclined angle relative to the bottom wall of the blower housing, wherein the back wall of the exhaust restrictor includes a generally planar lower portion and a curved upper portion including an outer end, the lower portion being positioned at the inclined angle.

7. The blower assembly of claim 6 wherein the first housing member and the second housing member are formed from stamped metal.

8. The blower assembly of claim 6 wherein the exhaust transition section is formed separate from the blower housing and is selectively attachable to the blower housing.

9. The blower assembly of claim 8 wherein the exhaust outlet of the exhaust transition section is offset from the housing exhaust opening.

10. The blower assembly of claim 9 wherein the housing exhaust opening and the exhaust outlet extend along parallel, spaced planes, wherein the back wall of the exhaust restrictor is angled relative to the planes of the exhaust outlet and the housing exhaust opening.

11. The blower assembly of claim 6 wherein the outer end of the exhaust restrictor is spaced inwardly from the exhaust outlet of the exhaust restrictor.

12. A blower assembly for use in expelling exhaust gases from a furnace through an exhaust pipe, comprising:

a blower motor having a motor shaft;

a blower housing having an internal impeller cavity defined by a top wall, an outer sidewall, and a bottom wall including an inlet opening, the blower housing being formed from a first housing member defining the top wall and the outer sidewall and a second housing member defining the bottom wall and the inlet opening;

a housing exhaust opening formed in the sidewall of the blower housing, the housing exhaust opening being in communication with the impeller cavity;

an impeller mounted to the motor shaft and contained within the impeller cavity, wherein rotation of the impeller creates a flow of exhaust gases into the impeller cavity through the inlet opening and out of the impeller cavity through the housing exhaust opening;

an exhaust transition section extending from a first end to an exhaust outlet, the first end of the exhaust transition section being coupled to the housing exhaust opening for receiving the flow of exhaust gases; and an exhaust restrictor integrally formed with the second housing member, the exhaust restrictor extending into the exhaust transition section at an inclined angle relative to the bottom wall, the exhaust restrictor being operable to restrict the flow of exhaust gases from the housing exhaust opening to the exhaust outlet, wherein the exhaust restrictor includes a back wall extending from an inner end to an outer end, wherein the back wall extends at the inclined angle and includes a generally planar lower portion and a curved upper portion including the outer end, the lower portion being coupled to the bottom wall of the second housing member and extending at the inclined angle relative to the bottom wall.

13. The blower assembly of claim 12 wherein the first housing member, the second housing member and the exhaust restrictor are formed from stamped metal.

14. The blower assembly of claim 13 wherein the exhaust transition section is formed from stamped metal and attachable to the blower housing.

15. The blower assembly of claim 14 wherein the housing exhaust opening and the exhaust outlet are contained in parallel, spaced planes and the exhaust restrictor is positioned at an angle relative to the plane of the exhaust outlet and the housing exhaust opening.

16. The blower assembly of claim 12 wherein the back wall extends at an inclined angle between 40°–60°.

17. The blower assembly of claim 12 wherein the outer end of the exhaust restrictor is spaced inwardly from the exhaust outlet of the exhaust restrictor.

* * * * *